United States Patent [19]

Rudolf et al.

[11] 4,068,797

[45] Jan. 17, 1978

[54] SAVINGS BANK

[75] Inventors: Hans Rudolf, Leutenbach; Gerhard Riegraf, Affalterbach, both of Germany

[73] Assignee: Gerhard Riegraf KG, Affalterbach, Germany

[21] Appl. No.: 743,666

[22] Filed: Nov. 22, 1976

[30] Foreign Application Priority Data

Nov. 28, 1975 Germany ..... 2553462

[51] Int. Cl.[2] ..... G07F 9/06

[52] U.S. Cl. ..... 232/4 R

[58] Field of Search ..... 232/4, 5, 6

[56] References Cited

U.S. PATENT DOCUMENTS

| | | | |
|---|---|---|---|
| 640,536 | 1/1900 | Cook | 232/5 |
| 743,442 | 11/1903 | Brown | 232/6 |
| 1,102,256 | 7/1914 | Fisher | 232/4 R |
| 1,206,380 | 11/1916 | Rupert | 232/4 R |
| 1,211,248 | 1/1917 | Scully | 232/4 R |
| 1,476,735 | 12/1923 | Stockel | 232/4 R |
| 1,700,986 | 2/1929 | Moran | 232/5 |
| 1,709,157 | 4/1929 | Salinger | 232/4 R |
| 2,648,494 | 8/1953 | Veschio | 232/5 |
| 2,784,903 | 3/1957 | Brasier | 232/4 R |

FOREIGN PATENT DOCUMENTS

| | | | |
|---|---|---|---|
| 7,412 of | 1902 | United Kingdom | 232/4 R |

*Primary Examiner*—Francis K. Zugel

*Attorney, Agent, or Firm*—Shlesinger, Arkwright, Garvey & Dinsmore

[57] ABSTRACT

A savings bank comprising molded upper and lower portions connectable to form a receptacle. The portions include engageable latch elements for securing the portions together so they may be disengaged upon insertion of a key.

6 Claims, 13 Drawing Figures

A
-12-

SAVINGS BANK

This invention relates to a savings bank of any suitable shape, consisting of a container having an upper part provided with a slot for depositing money and of a lower part with an opening for locking which are moulded from a sprayable plastic substance.

Known savings banks manufactured from plastic normally have a base opening into which a plate with a lock, operable with a key, is inserted, whereby the key, if necessary, can also be constructed as a magnet for a magnetic closing. In the case of usual embodiments of savings banks there is an opening in the housing, preferably on the base into which a base wall is inserted or welded, which in its part contains an opening for the plate with a lock. In more complicated designs of savings banks the housing is comprised, for example, of two half-shells or several individual component parts and welded together, whereby then also, the opening for insertion of the plate with a lock is provided in one wall.

The production of such savings banks requires, in addition to production and storage for the different component parts, considerable work spent for assembly since the savings bank and the base part containing the opening for insertion of the plate with a lock must be assembled in a mould and glued there, which leads to additional interim storage, use of space, handling procedures and, thereby, to sources of error and waste.

Since in the case of such plastic savings banks it is primarily a matter of mass articles which are usually given free of charge for publicity and can therefore require only small production costs, considerable savings can be sometimes achieved by relatively small modifications or improvements.

It is the purpose of the invention to develop a savings bank of the design specified at the outset so that the assembly is designed especially simply and no additional work, which requires special skills, mutual adjustment and welding of the synthetic parts with each other, occurs. Despite the simple manner of construction desired, the savings bank should have an attractive exterior.

According to the fundamental idea of the invention, this problem is solved in that an expandable plug installation is moulded on the upper one-piece hollow-piece part, into which can be snapped a plug formed on the base portion, extending into its interior space. Preferably, the expandable plug socket is formed on both sides as a slot housing with an inner cross-section corresponding to the outer side of the plug.

The assembly requires only the insertion into one another of the base portion bearing the plug and the upper portion containing the expandable plug installation. All necessary assembly procedures for the known savings banks are eliminated since the component parts to be constructed together ready to be snapped together are extended from the expandable apparatus. The assembly procedure as the user performs after opening the savings bank in order to join both component parts anew.

Although the invention is also described on an axially symmetrical embodiment to which the designations upper portion and base portion refer, the characteristics of the invention can also be realized advantageously with all other designings of sections or profiles. For example, with a spherical savings bank two equal half-shells would be provided, whereas with a hexahedron its insignificant which surface serves as base and contains a moulded plug.

In the further development of the invention the plug has side recesses into which can be snapped lugs moulded inside on the plug socket. Moreover, the plug can exhibit side ribs for insertion into the slot of the plug installation. In this way an assured control and a good form-locking intermeshing or interlocking of the fastenings of hollow-body part and base part are assured.

An essential characteristic of the invention consists in that not only the plug installation but also the plug is designed hollow and exhibits an outer connecting opening. The advantage lies in that in the production of the apparatus, rigid moulded plugs can be used. Moreover, the hollow plug serves for the mounting of a key and together with the expandable plug installation, forms the lock of the savings bank.

Fundamentally, the savings bank according to the invention can have any design desired. In the event that the savings bank is designed circular cylindrically in the area of its division, a protection against torsion between the half-shells must be provided so that in the relative torsion the plug does not expand the casing, thereby freeing the lock. In an oval or multi-cornered cross-section of the savings bank this protection against torsion can be eliminated.

DESCRIPTION OF THE DRAWINGS

Further details and advantages of the inventin are also shown in the claims as well as the following description of exemplary embodiments by means of sketches:

DESCRIPTION OF THE INVENTION

Figures 1, 2, 3, 4:
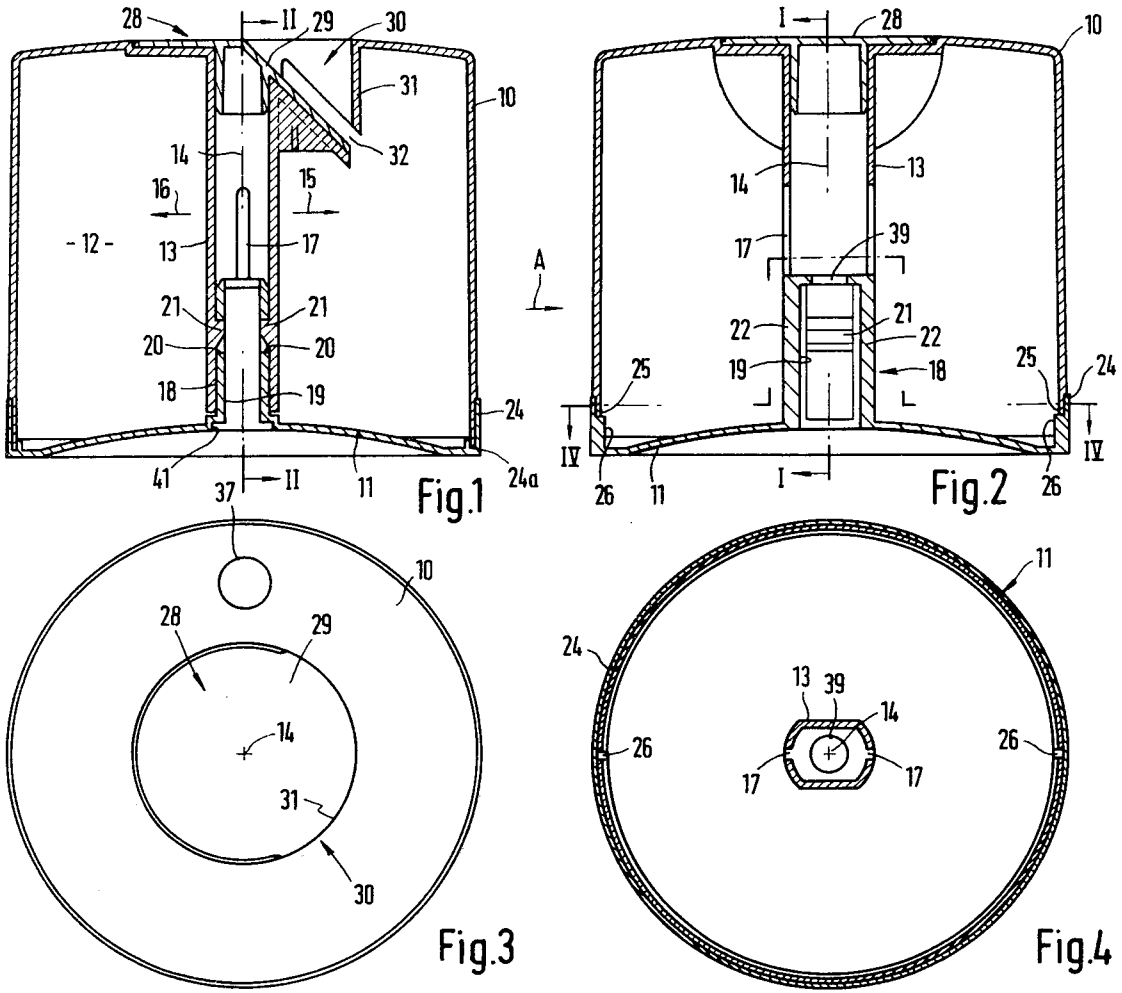
FIG. 1 savings bank according to the invention in vertical elevation according to the line I—I of FIG. 2
FIG. 2 a profile according to line II—II in FIG. 1.
FIG. 3 the savings bank according to FIG. 1 in top-plan view.
FIG. 4 a profile according to line IV—IV in FIG. 2.
Figure 5:
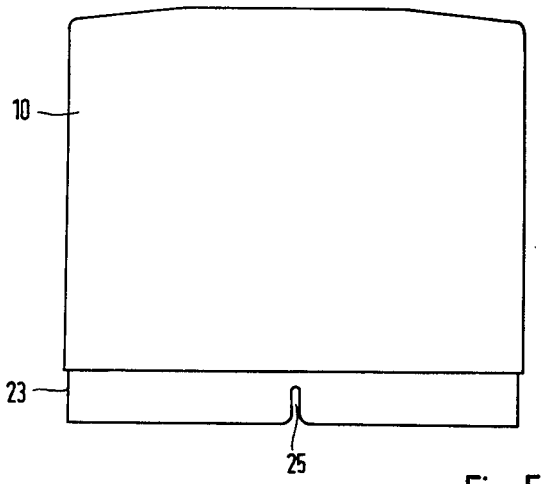
FIG. 5 the upper container portion in direction of arrow A according to FIG. 2.

According to FIGS. 1–5 the savings bank consists of an upper part 10 and a base 11, preferably out of plastic. On the cover of the upper part 10 there is an expandable plug insertion 13 extending into the interior space 12. The plug insertion 13 designed as an open tube is formed on this concentrically with the longitudinal axis 14 of the cylindrical upper part 10. The expandability in direction of arrow 15, 16 (FIG. 1) is achieved by two opposite elongated slots 17 bifurcating the distal end of the member 13 as shown.

The circular base part 11 in top plan view has a hollow plug 18 formed concentrically with the axis 14. The plug 18 has two side, right-angled openings 20 into which two lugs 21 of the expandable plug installation 13 engage. Openings 20 and lugs 21 can be provided in different heights in order to enable lock combinations.

Side ribs 11 which extend into the slot 17 of the plug installation 13 can be formed horizontally on the plug 18. In this way reciprocal guidance can be achieved. The construction parts 10, 11 are also joined at the circumference. For this purpose the upper portion 10 has a rim 23 recessed in diameter which is inserted behind a rim 24 of the base part 11, whereby according to FIG. 1 an annular tee-slot 24*a* can be provided. The rim 23 of the upper part 10 has two diametrically-arranged slots 25, which overlap two formed connections 26 at the base part 11 (FIGS. 2 and 4). By this alternating torsion protection of both hollow-body parts 10 and 11, an improper opening of the lock by reciprocal twisting is avoided.

Figure 6:
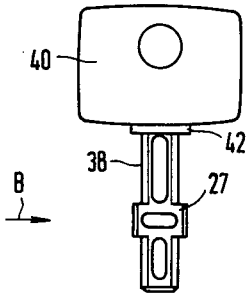
FIG. 6 a key for opening the savings bank.
Figure 7:
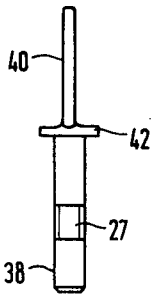
FIG. 7 the key according to FIG. 6 in direction of arrow B.
Figure 8:
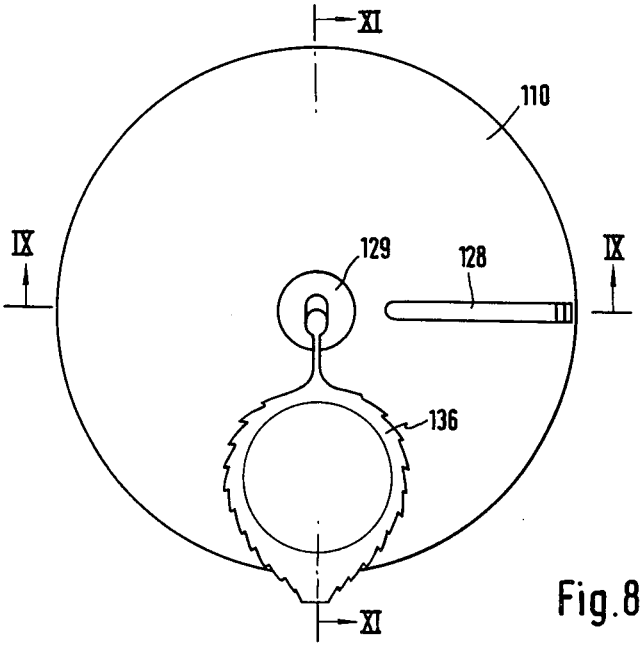
FIG. 8 a top-plan view of a savings bank according to the invention in an apple form.
Figure 9:
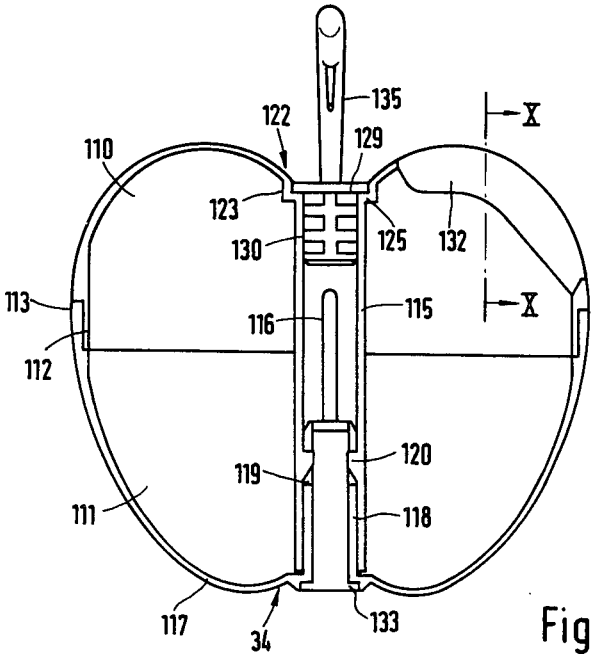
FIG. 9 a cross-section according to the line IX—IX in FIG. 8.
Figure 10:
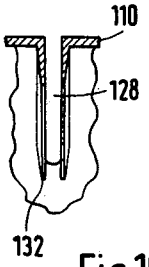
FIG. 10 a partial cross-section according to the line X—X in FIG. 9.
Figure 11:
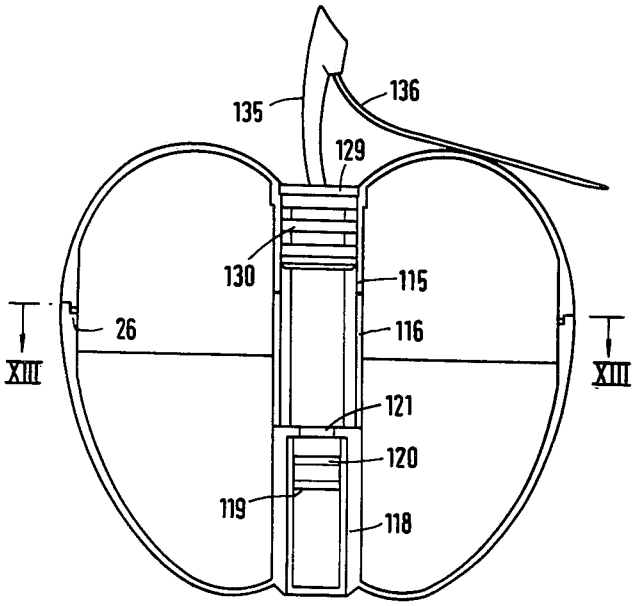
FIG. 11 a cross-section according to the line XI—XI in FIG. 8.
Figure 12:
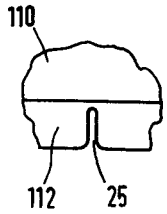
FIG. 12 a partial view of the periphery portion of the upper half-shell in the area of the protection against torsion and FIG. 13 a horizontal cross-section according to the lines XIII—XIII in FIG. 11.
Figure 13:
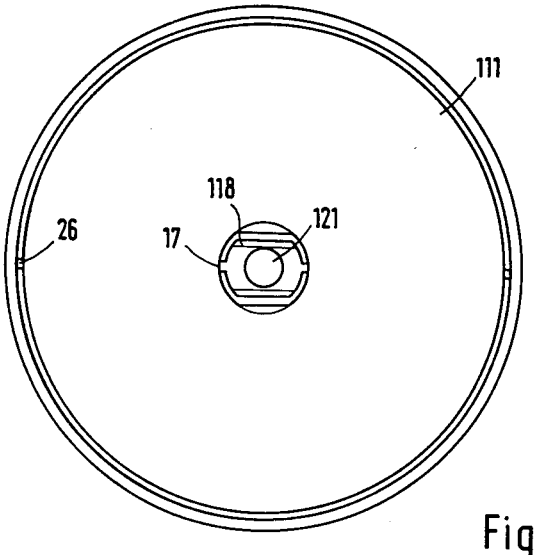

The hollow space 19 of the plug 18 serves for mounting of the key illustrated in FIGS. 6, 7 which, like the savings bank, can be produced from plastic. The key is thus measured so that its projections 27, upon fully inserting the key into its plug, is located exactly at the top of both side recesses inasmuch as the key, in accordance with the combination, is attached to the savings bank. By turning key, both reinforcements 21 are expanded in direction of arrow 15, 16 until the base part 11 can be extracted from the expandable plug installation 13. No key is required for closing the savings bank since the reinforcements 21 with their inclinded planes are thereby expanded through the plugs 18 and engage automatically in the recesses 20.

While the lower end of the plug 18 serves for mounting the key, the upper opening of the plug installation 13 is closed by an engaged or glued-in encasement 28, which is provided with or colored with advertising imprints, trademarks, etc. In the covering wall of the upper part there is an approximately semicircular inversion 30, which is formed by a vertical or slightly conical semicircular sidewall 31 and a sloping base surface proceeding from the covering wall whose angle of gradient is 45° for example. The sloping base surface extends from a horizontal, slightly recessed base surface, which according to FIG. 1, forms a complete circle together with the inversion 30. The lower end of the side wall 31 has above the inclined plane a slot 32 for inserting money, which extends across an arc of about 150°. By this construction an additional assurance against an unintended removal of money is eliminated. The encasement 28 is inserted into the circular recess and has a level surface resting on the horizontal recess of the wall and a sloping surface joining onto it and in addition, bears a molded plug on its underside for supporting it by force-fit in the plug installation 13.

The savings bank shown in FIGS. 8–13 is designed like an apple and consists again of an upper half-shell 110 and a lower half-shell 111 which has overlapping rims 112 and 113 in the area of its greatest diameter. The rim of the upper half-shell 110 consists of a portion reset radially inwards, which is overlapped by an outer rim 113 which is formed on the lower half-shell and has a corresponding recess on its inner side.

On the inner side of the upper half shell 100 the tubular plug installation 115 is formed with longitudinal slots 116. On the arched base wall 117 a hollow plug is concentrically formed which is accessible from the underside. The plug 118 has recesses 119, into which projections 120 extend on the inner side of the plug installation 115. The latching of its device is not possible until the rim regions 112, 113 of both half-shells overlap one another completely.

The narrowed guide opening 121 is provided at the upper end of the plug 118 for guiding the key inserted from the base out. An additional circular key guide 133 is at the entrance of the hollow plug.

In the middle upper inversion 122 there is a vertical wall section 123 and a ring-shaped wall section 125 connected to its as mounting for an encasement 129. The encasement has molded plug 130 for mounting with press fit in the tube-shaped plug installation 115. For manipulation of the encasement 129 a handle 135 consisting of an elastic substance is formed from which a leaf 136 also consisting of plastic entends.

The upper half-shell a slot 128 for inserting money is provided which slot has extended slot corners 132 drawn out from the contain wall inward which serves as assurance against moving money. Besides a slot for inserting money, an additional circular opening can, for example, also be provided for inserting paper money.

While this invention has been described as having a preferred design, it will be understood that it is capable of further modifications. This application, is, therefore, intended to cover any variations, uses, or adaptations of the invention following the general principles thereof and including such departures from the present disclosure has come within known or customary practice in the art to which this invention pertains, and as may be applied to the essential features hereinbefore set forth and fall within the scope of this invention or the limits of the claims.

What we claim is:

1. A molded savings bank consisting essentially of:
first and second hollow body parts, said parts being molded so as to fit together and thereby form an essentially closed hollow money chamber,
said first body part including an elongated hollow plug member integrally formed therewith,
said second body part including an elongated hollow socket member integrally formed therewith,
said plug member and said socket member having interfitting cross-sectional configurations and being of lengths such that said members telescopically engage each other over a substantial portion of their length,
a distal end of said socket member including furcations formed such that said socket member is radially and resiliently expandable,
said socket member further including inwardly projecting lugs integrally formed on said furcations,
said plug member including recesses formed therein equal in number to the number of said lugs and axially disposed so as to be engaged by said lug when said body parts are united for releasably locking said body parts together, and
a money slot formed in one of said body parts.

2. Savings bank according to claim 1, characterized in that said socket and said plug have a partially flattened cross-section coordinated on one another, whereby the flats run parallel to the slots forming said furcation.

3. Savings bank according to claim 1 and including, a key with projection means located in axial alignment with said recesses when said key is inserted in said plug member to disengage said plug member from said socket member.

4. Savings bank according to claim 1 characterized in that said socket member and said plug member are arranged approximately in the vertical axial center of said savings bank.

5. A molded savings bank as in claim 1 and wherein:

said plug member includes projecting ribs integrally formed thereon engagable with the slots forming said furcations for preventing relative rotation of said body parts.

6. A molded savings bank according to claim 1 wherein:

said hollow socket member is open at its end adjacent said second body part, an enclosing member inserted in said socket member at said end and including said money slot formed therein.

* * * * *